US005347790A

United States Patent [19]

Romanenko et al.

[11] Patent Number: 5,347,790

[45] Date of Patent: Sep. 20, 1994

[54] AUTOMATIC TRAYING AND AUTOMATIC SWEEPING DEVICE FOR LETTER MAIL

[75] Inventors: Michael Romanenko, South Elgin; Gerald D. Ross, Streamwood, both of Ill.

[73] Assignee: ElectroCom Gard, Ltd., Niles, Ill.

[21] Appl. No.: 982,976

[22] Filed: Dec. 1, 1992

[51] Int. Cl.[5] ..... B65B 23/14; B65B 35/00

[52] U.S. Cl. ..... 53/443; 53/247; 53/436; 414/790.3

[58] Field of Search ..... 414/788.1, 790.1, 790.2, 414/790.3, 790.6, 924, 926; 53/247, 436, 447, 540, 443

[56] References Cited

U.S. PATENT DOCUMENTS

| | | | |
|---|---|---|---|
| 2,877,885 | 3/1959 | Wheeler, Jr. . | |
| 3,000,151 | 9/1961 | Winkler et al. | 53/443 |
| 3,199,688 | 8/1965 | Levy . | |
| 4,037,525 | 7/1977 | Sjogren et al. . | |
| 4,523,502 | 6/1985 | Besemann . | |
| 4,538,511 | 9/1985 | Wise . | |
| 4,554,867 | 11/1985 | Thumm . | |
| 4,723,883 | 2/1988 | Smith . | |
| 4,772,003 | 9/1988 | Nobuta et al. . | |
| 4,879,862 | 11/1989 | Nolte et al. | 53/443 |
| 4,993,916 | 2/1991 | Dorner . | |
| 4,997,337 | 3/1991 | Trimble . | |
| 5,044,876 | 9/1991 | Stohlquist . | |
| 5,095,684 | 3/1992 | Walker et al. | 53/443 |
| 5,117,614 | 6/1992 | Johnson | 53/247 |

*Primary Examiner*—W. Donald Bray
*Attorney, Agent, or Firm*—Hill, Steadman & Simpson

[57] ABSTRACT

An automatic device for sweeping letter mail or alternatively, stacking and sweeping letter mail, and depositing the resultant stack into a managed mail tray. The sweeping device provides an accumulation platform which receives a stream of mail, the platform having a slidable end plate urged against the accumulating stack of mail which overcomes the urging of the end plate to fill the accumulation platform. A sweep plate is thereafter actuated to pierce the stack and thereafter translate towards the end plate to compress the now captured stack to a specified length. The specified length correspond to trap doors provided in the accumulation platform which thereafter open to vertically drop the stack into a managed mail tray arranged therebelow. A forward plate is provided to pierce the stack with the sweep plate to hold back further accumulated mail while the specified stack is being compressed and deposited. In another embodiment a non-sliding blade is translated upwardly to pierce the accumulating stack at a position corresponding to the length of the trap door. Additionally, a sweeping and stacking device is provided which receives shingled mail pieces onto a conveyor belt which is engaged with an overhead pinch belt which partially wraps around a roller of the conveyor belt. The shingled mail is horizontally carried on the conveyor belt and turned vertically by the pinch belt to a position below the conveyor belt into an accumulation platform. An end plate is slidably held in the accumulation platform to insure a horizontal stack accumulation of the thus turned mail. The accumulation platform has trap doors which deposit a specified length of accumulated mail into a managed mail tray arranged therebelow.

22 Claims, 8 Drawing Sheets

FIG. 4a
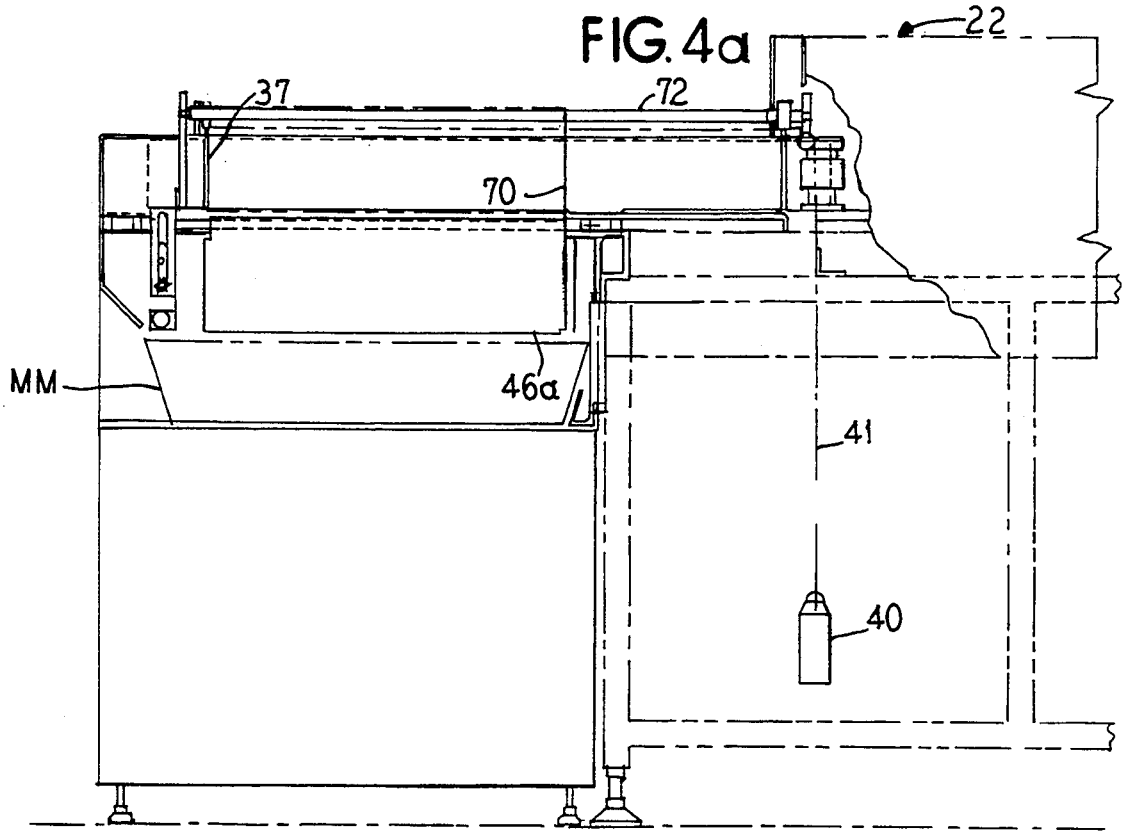
FIG. 4b
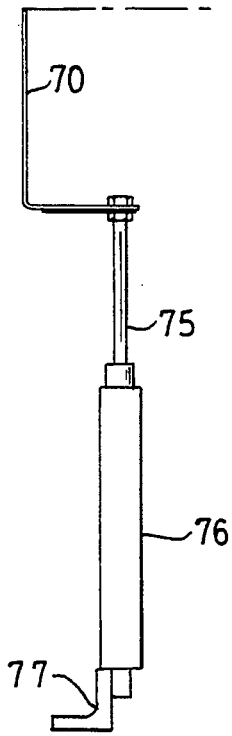
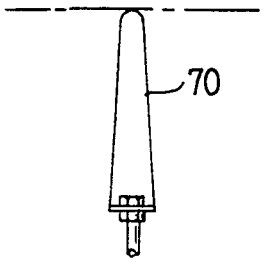
FIG. 4c

AUTOMATIC TRAYING AND AUTOMATIC SWEEPING DEVICE FOR LETTER MAIL

BACKGROUND OF THE INVENTION

The general area of application of the present invention is the automation of postal operations, and specifically, automatic sweeping and traying of accumulated mail stacks that are formed at output stackers in USPS letter mail sorters employing either Optical Character Readers (OCR) or Bar Code Readers (BCR). The sweeping operation involves the vertical transfer of a vertical mail stack from the stacking platform (at a sortation station) into a USPS "MM" (managed mail) tray located directly below. Presently this sweeping operation is performed manually.

An additional application of this invention is the automatic stacking and traying of letter mail. This automatic application also reduces manual tasks with resulting economies. The mail output of automatic label placement machines such as the Xerox Cheshire Mod Series machines consists of a continuous stream of shingled (overlapping) mail, laying horizontally and moving width-wise (short dimension). Presently this output is placed on a flat belt conveyor, and removed manually. The mail is then placed, faced, in a standard USPS MM tray.

SUMMARY OF THE INVENTION

It is an object of this invention to reduce the resource requirements for the above-mentioned letter mail sorters by automating the sweeping operation. It is also an object of the invention to accomplish this transfer with a minimum disturbance to the stack residing on the stacking platform, and to execute this maneuver in a considerably shorter period of time than is presently required to do it manually.

An apparatus and method is produced for stacking or arranging pre-stacked mail in a staging area above a mail tray, separating the stacked mail into a predetermined stacked length corresponding to the length of the corresponding mail tray and vertically dropping the stacked mail through trap doors into the mail tray. In an alternate embodiment, the mail is received in a shingle arrangement from a conveyor belt and horizontally stacked in the staging area before dropping into the mail tray.

The automatic sweeping device as described herein is intended to work in conjunction with the currently deployed OCR and BCS sorting machines that feature multiple output stackers. In an actual application, there would be one Automatic Sweeping Device mated either to each stacker or to an OCR or BCS sorting machine or to designated high-volume stackers, the function of such a stacker being the diversion of all mail pieces, from the main transport stream, to a particular destination at which an output stack of sorted mail is being formed.

The formation of this output stack is currently performed in an accumulation area of the stacker, where the stack must be manually removed and deposited into an MM tray. The present invention is a device that proposes to replace the accumulation area of the commercially available stackers: the stack would be accumulated in the automatic sweeping device that includes a means of automatically (non-manually) transferring the stack to an empty MM tray positioned directly below.

The mechanical sweeping device of the present invention possesses inventive features, including:

a) the ability to "slice" a vertical stack of mail into two parts, a larger downstream part and a smaller upstream part, in such a manner that the two parts become totally separated from each other;

b) the aforementioned "slicing" action being accomplished by means of a knife-like penetration of two interlocking plates that are driven edgewise into the stack while the plates translate in a vertical plane that is essentially parallel to the midplane of the mail pieces in the stack;

c) the ability to accomplish the aforementioned "slicing" action in a manner that is non-damaging to the mail pieces coming into contact with the penetrating plates at the point of penetration into the stack;

d) the ability to accurately position the downstream half of the stack over a trap door in the stack accumulation area;

e) the ability to accomplish a vertical transfer of the downstream part of the stack in the accumulation area into an MM tray, in such a manner that the orientation of mail pieces in the stack is not disturbed, i.e., the stack being transferred undergoes a vertical translation during which it behaves as a rigid body; and f) the ability to continue accepting new mailpieces from the output stacker while the stack transfer is in progress, i.e., the stack transfer operation causes no disruption of the normal diversion of the mailpieces from the main transport into this particular output stacker; which is true if the operator removes filled mail tray and resets for the next cycle in a short period of time.

It is also an object of the present invention to collect a stream output of a conveyor, orient the mail vertically, and transfer an accumulated mail stack automatically to the MM tray. This described automatic stacking and traying device can be placed immediately adjacent to the end of the conveyor and requires little modification of the existing equipment.

The automatic stacking and traying device of the present invention provides flat belts arranged for receiving shingled mail in a substantially horizontal plane. The shingled mail is delivered to pinch belts which pinch the mail between the pinch belts and the flat belts and maneuver the shingled mail downwardly into a horizontally stacked queue. The queue accumulates in an accumulation area above trap doors for eventual vertical downward translation into an MM tray.

BRIEF DESCRIPTION OF THE DRAWINGS

FIG. 4*a* is a front elevational view of an alternate embodiment of the present invention;

FIG. 4*b* is an enlarged partial view of a portion of the invention shown in FIG. 4*a;*

FIG. 4*c* is a partial right side elevational view of FIG. 4*b;*

DETAILED DESCRIPTION OF THE PREFERRED EMBODIMENT

Figure 1A:
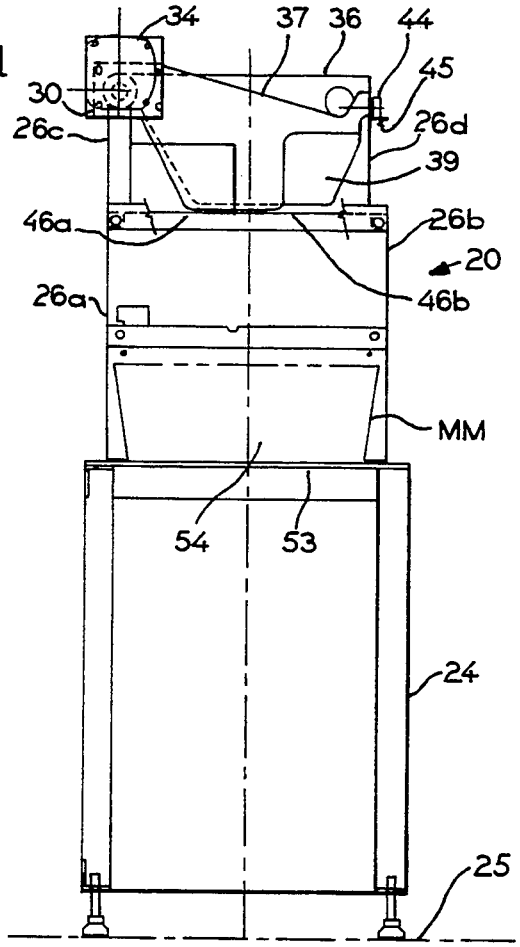
FIG. 1*a* is a left side elevational view of the present invention.
Figure 1B:
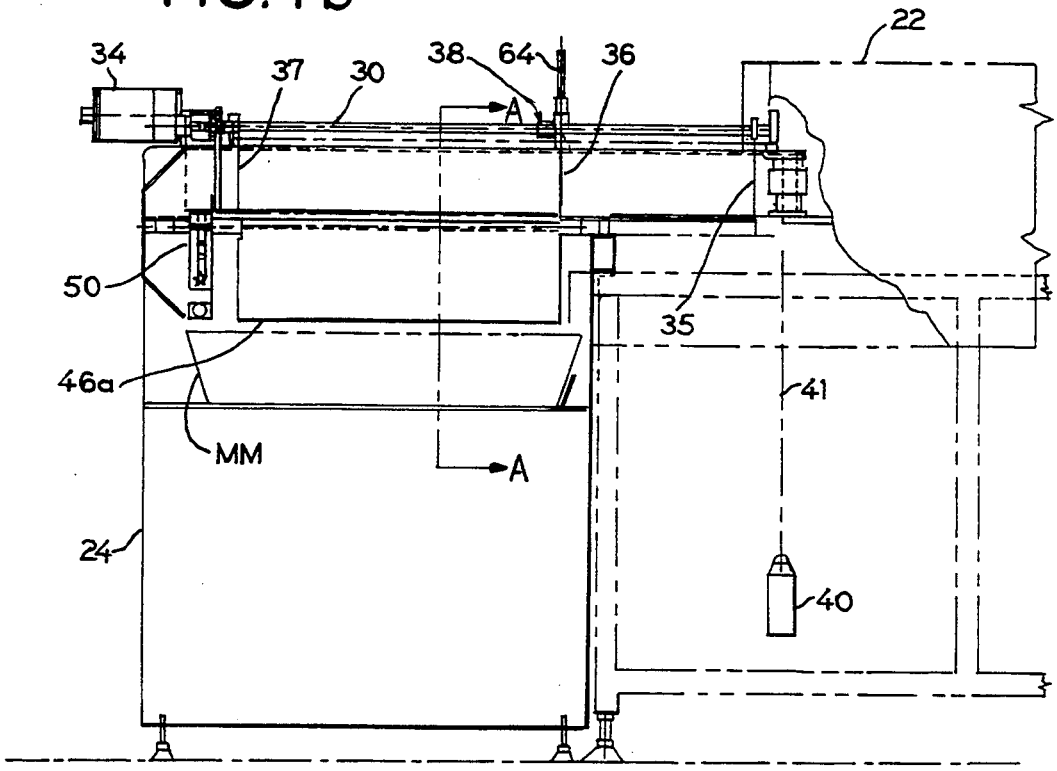
FIG. 1*b* is a front elevational view of the present invention.

As shown in FIGS. 1*a* through 1*d*, an Automatic Sweeping Device (ASD) 20 is mounted with a mail stacker 22 which passes stacked mail 23 to the ASD 20. The ASD 20 has a support stand 24 supported on a floor line 25. Mounted on top of the support stand 24 are two sidewalls, 26(*a*) and 26(*b*) which, together with some cross members, constitute a box-like structure that supports remaining components of the ASD. Mounted along a top edge of the left sidewall there is a lead screw 30, at one end coupled to a reversible gear motor 34. The lead screw is used to support and guide three moveable plates: a forward support plate 35, a sweep plate 36 and a rear support plate 37. The sweep plate 36 engages the lead screw 30 via a nut 38 rigidly attached to this plate so that the rotation of the lead screw causes the sweep plate to translate back and forth along the trough-like cavity or trough 39 formed by upper parts 26*c*, 26*d* of the sidewalls 26*a*, 26*b*.

The other two plates 35 and 37 engage the lead screw via bushings 35*a*, 37*a* whose inside diameter is only slightly larger than the outside diameter of the lead screw so that these plates are free both to pivot about and to slide along the lead screw 30. The rear support plate 37 is connected to a counterweight 40 through a thin cable 41. In this manner, the rear support plate 37 is subjected to a constant bias force that tends to keep this plate 37 shifted toward the front of the ASD and in the absence of any mail in the trough, the rear support plate 37 bears against the sweep plate 36.

All three translating plates 35, 36 and 37 are equipped with support rollers 44 at their opposite lateral sides. The support rollers ride on a track 45 that is part of the sidewall 26*b*.

A bottom of the trough 39 consists of two pivotally mounted leaves 46*a,b* in a trap door arrangement. The pivot axes of these leaves 46*a,b* lie immediately outboard of the upper parts 26*c*, 26*d* of the sidewalls 26*a*, 26*b* so that when the leaves 46*a,b* are rotated down, the distance between the now-vertical upper surfaces of the leaves is slightly larger than the separation distance between the upper parts 26*c*, 26*d* of the sidewalls in the trough region 39. The leaves 46*a,b* are pneumatically actuated through a linkage 50 that insures simultaneousness of their motion. This linkage is shown in phantom lines in FIG. 1*d*. Normally, the doors are closed, i.e., the two leaves are in the "up" position, forming a flat, horizontal surface that constitutes the floor of the trough. They are opened (i.e. rotated downward) only when it becomes necessary to perform the sweep maneuver, as subsequently explained.

A floor sheet 53 is located at the top of the support stand 24, spanning the distance between sidewalls. The floor sheet serves to support an empty tray MM, inserted into a cavity 54 below the trap door for the purpose of capturing a letter stack S during the execution of the sweeping maneuver.

Figure 1C:
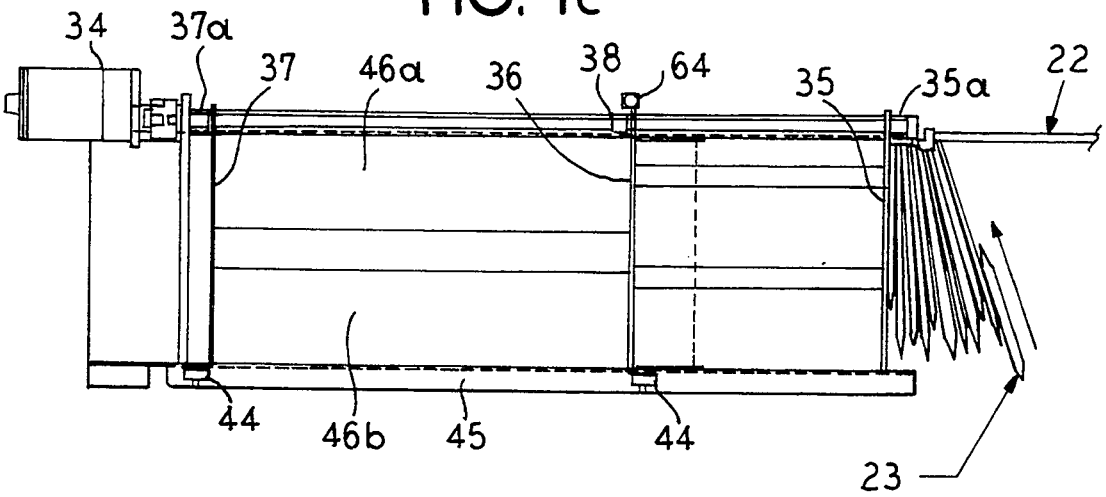
FIG. 1*c* is a plan view of the present invention.

FIG. 1*c* shows in plan, mail pieces 23 arranged against the forward support plate 35, delivered from the stacker 22. The rear support plate 37 and the sweep plate are shown in orientation for a sweep maneuver, although the mailpieces 23 which form the stack S between the plate 35, 37 are not shown for clarity.

The ASD 20 is equipped with a number of suitably located limit switches whose function is to monitor the positions of the various translating plates. Signals from these sensors are used as inputs into a control system that is dedicated to a particular ASD.

The functioning of the ASD will now be described by analyzing a typical sweeping cycle. The operational sequence is shown in FIG. 2*a* through 2*g*.

Figure 2A:
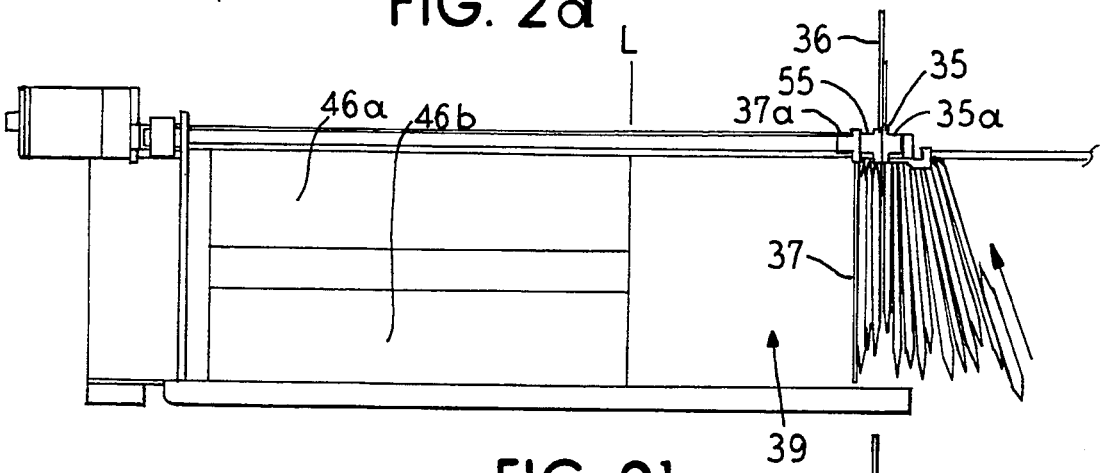
FIG. 2*a* is a plan view of the present invention in a first stage of loading.

FIG. 2*a* shows the ASD in the "empty" state. The plates 35 and 36 are in an "up" position. The plate 37 is pulled up tight against a positive stop 55. Mail diverted to this particular ASD is being stacked to the right of the plate 37. The door leaves 46*a*, 46*b* are in the "up" position.

Figure 2B:
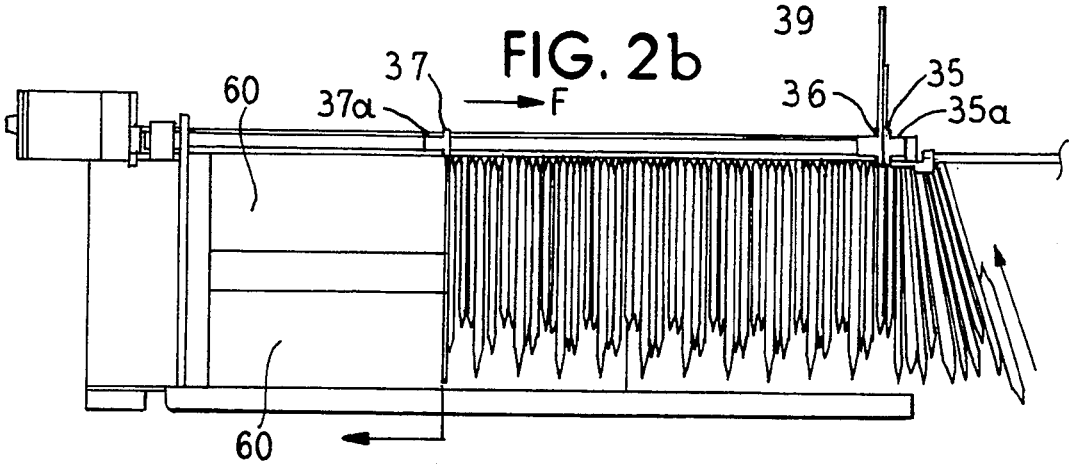
FIG. 2*b* is a plan view of the present invention in a second stage of loading.

FIG. 2*b* shows progressive horizontal growth of the stack S in the trough. The lead screw is still at rest, and the plates 35 and 36 are still up. Mailpieces continue being inserted at the input end of the stack, and as the stack grows in length, it pushes the rear support plate 37 to the left, against a constant but slight resistance F (which equals the weight of the counterweight). To facilitate the stack formation by reducing the friction between the lower edges of mailpieces and door leaves 46*a*, 46*b*, the latter are lined with strips 60 of anti-friction material such as Teflon.

Figure 1D:
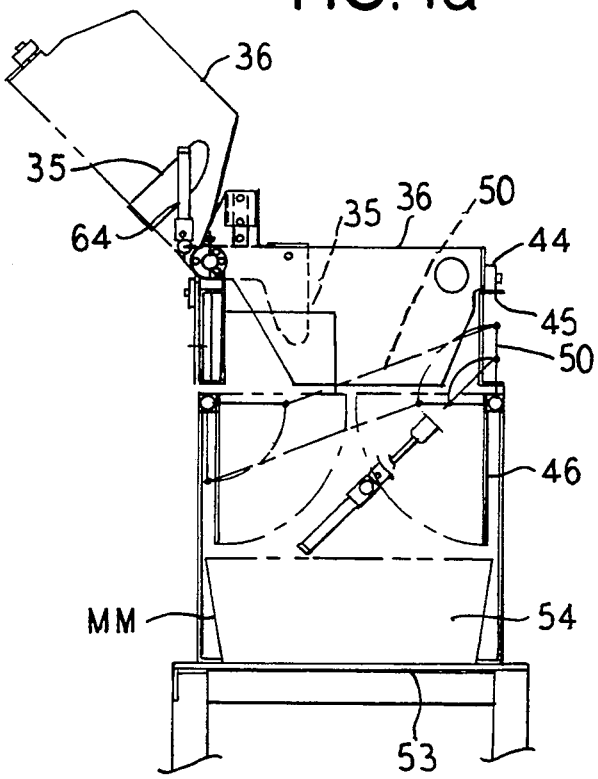
FIG. 1*d* is a right side elevational view of the present invention.
Figure 2C:
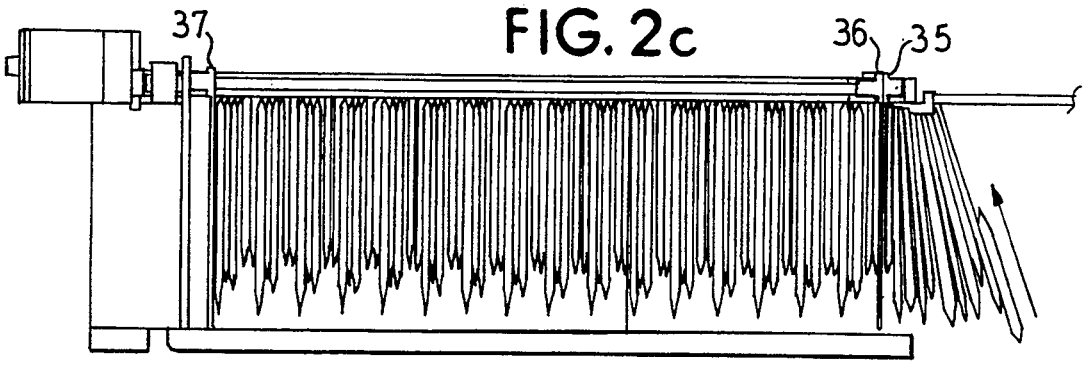
FIG. 2*c* a plan view of the present invention in a third stage of loading.

FIG. 2*c* shows the state at the maximum excursion of plate 37, a proximity sensor has detected this condition, and a control system has issued a command for the gear motor to start rotating the lead screw 30 in the CW direction (as seen as FIG. 1*a*). Simultaneously, a pneumatic actuator 64 is energized to extend. This latter action causes the two plates 35, 36 that are mechanically coupled to swing from the "up" position to the "down" position (FIG. 1*d*). In doing so, these two plates penetrate into the stack, thus dividing it into two parts. Proximity sensors are provided for detection of whether or not the two plates have successfully penetrated the stack and arrived at their desired "down" position. In case the first attempt at stack penetration is unsuccessful, such as when the "cutting" edge of the sweep plate 36 hangs up on the edge of a mailpiece rather than wedging itself between two adjacent mailpieces, then the control system commands another attempt which consists of, first, a retraction and then a repeated insertion of the two plates. If the second attempt is still without success, then a third attempt is made. The probability of the third attempt failing is very low, as testing has indicated.

Figure 2D:
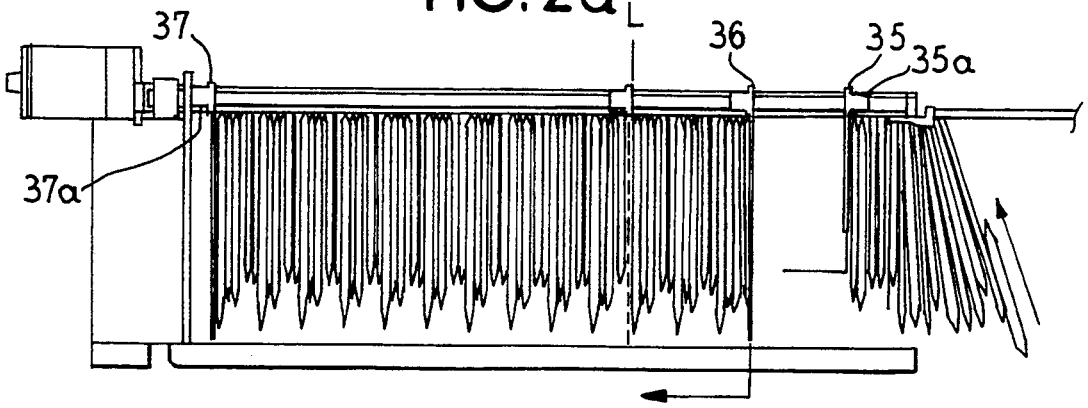
FIG. 2*d* is a plan view of the present invention in a fourth stage of loading.

FIG. 2*d* shows the rear support plate 37 at its maximum leftward excursion, the forward support plate 35 slowly drifting to the left (driven by the pressure exerted on it by the growing stack to the right of it), and the sweep plate 36 rapidly advancing to the left (driven by rotation of the lead screw). Movement of the sweep plate stops upon reaching position L. In this position the stack is slightly compressed and positioned entirely within the length of the trap door, defined by the leaves 46*a,b*. Once the sweep plate 36 has reached position L, the lead screw motion stops and immediately the trap door opens, thus allowing the stack (that was heretofore clamped between plates 36 and 37) to free-fall into the tray MM directly below.

Figure 2E:
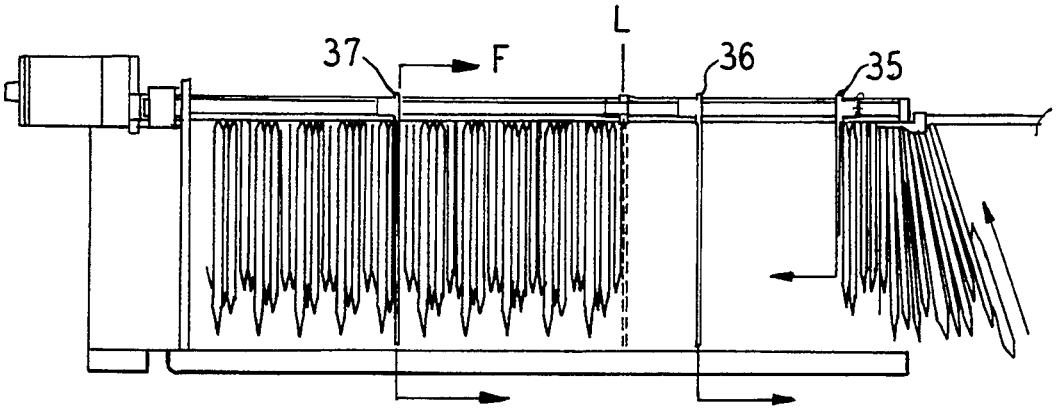
FIG. 2*e* is a plan view of the present invention in a fifth stage of loading.

FIG. 2*e* shows that immediately after opening the trap door, the lead screw rotation is started in the opposite direction, which causes the sweep plate 36 to shift to the right. Meanwhile, with the stack out of contact with it, i.e., the stack is now below, the rear support plate 37 starts traversing to the right (propelled by the action of counterweight) until it catches up with the sweep plate 36.

Figure 2F:
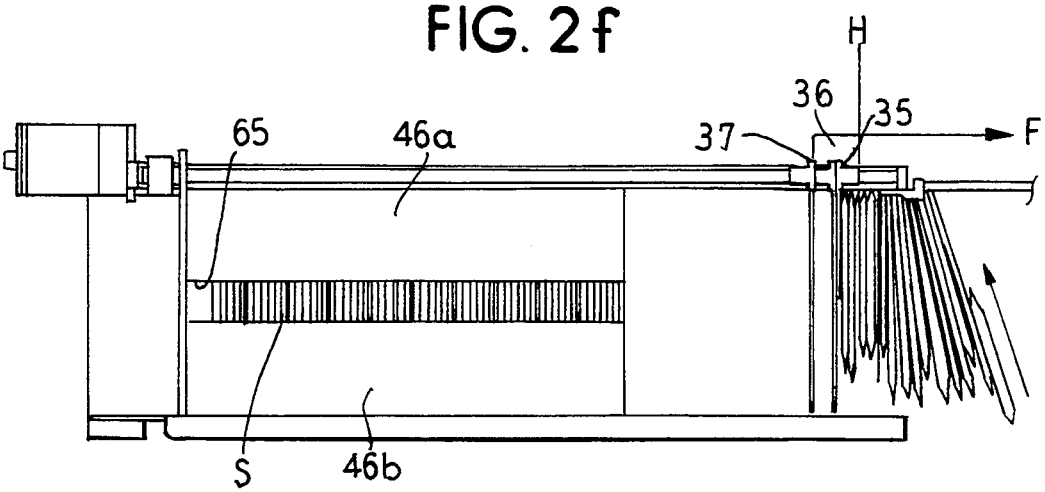
FIG. 2*f* is plan view of the present invention in a sixth stage of loading.

FIG. 2*f* shows that all three translating plates 35, 36, 37 have just arrived at their forward-most positions which are defined by a limit switch, and the trap door 46*a,b* is closed. The stack S below can be seen through a longitudinal gap 65 arranged between the leaves 46*a*, 46*b*.

Figure 2G:
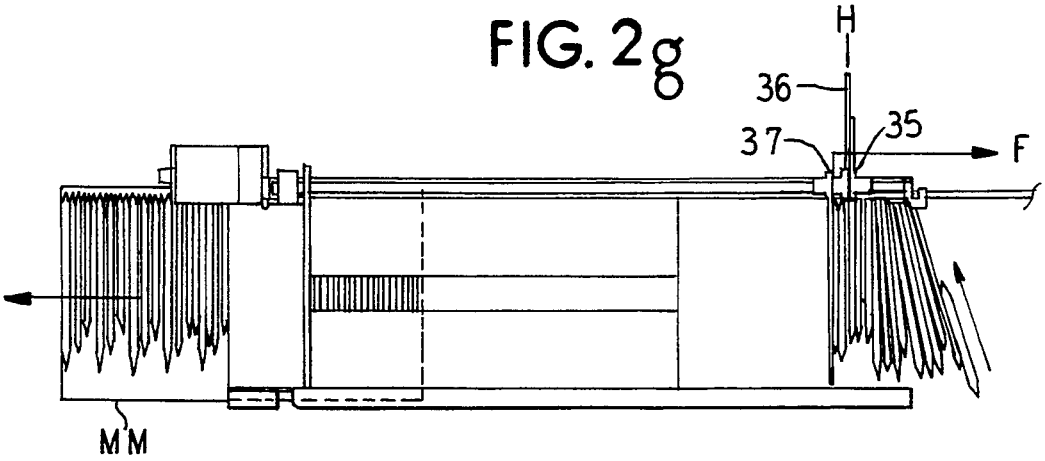
FIG. 2*g* is a plan view of the present invention in a seventh stage of loading.

FIG. 2*g* shows that the lead screw rotation stops once the sweep plate 36 has reached its home position M. In this position the sweep plate 36 is again in intimate contact with the forward support plate 35, as shown in FIG. 3*c*, coupled with the latter for rotary motion by means of a short pin 68. Once at position H, the two plates 35 and 36 are immediately retracted, actuator 64 rotates them from the "down" to the "up" position. The smaller portion of the stack, formerly in contact with plate 35, now suddenly shifts to the left until stopped by plate 37 (this shift is caused by pressure on the right-hand face of the stack, created by the action of new mailpieces being inserted by the diversion mechanism of the output stacker). Note that the state shown in FIG. 2*g* is identical to that of FIG. 2*a*.

Figure 3A:
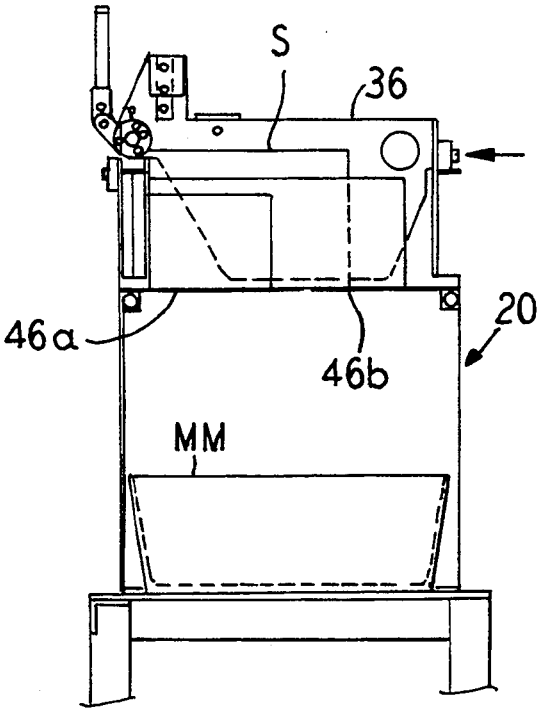
FIG. 3*a* is a right side elevational view of the present invention showing a position of stacked mail before sweeping.
Figure 3B:
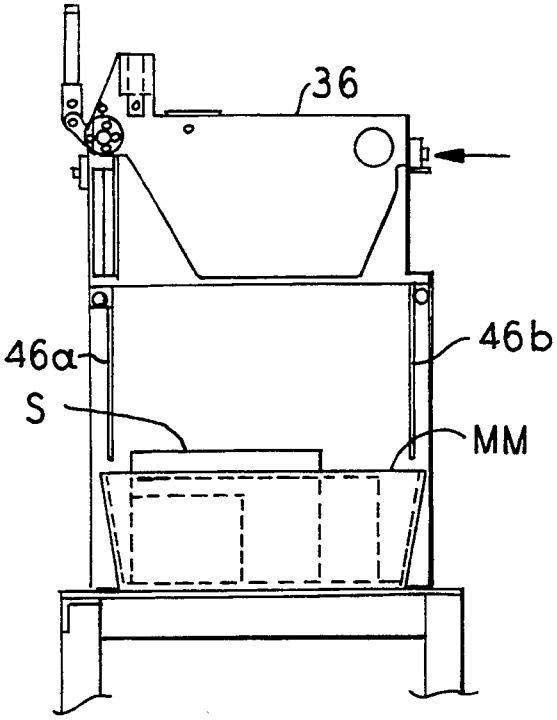
FIG. 3*b* is a right side elevational view of the present invention showing the stacked mail after sweeping.
Figure 3C:
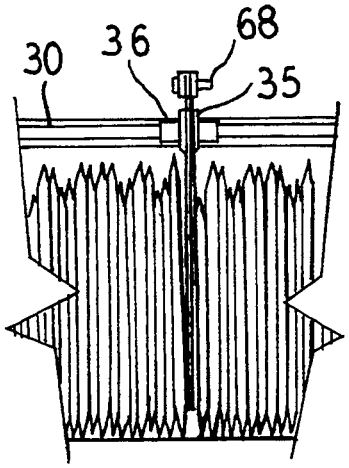
FIG. 3*c* is a partial elevational view of the present invention showing penetration of plates into the stack of mail.

FIG. 3*a* shows the ASD 20 in the configuration of FIG. 2*d* with the sweep plate 36 at position L just before release of the leaves 46*a,b*, and FIG. 3*b* shows the ASD just after release of the leaves 46*a,b*. The stack S has been translated, i.e, dropped, into the tray MM.

FIG. 3*c* shows the sweep plate 36 interlocked with the forward support plate 35 by a short pin 68 in the position of FIG. 2*c*.

Resetting of the sweep cycle is enabled by the removal of the full tray MM and its replacement with an empty tray. The ASD control system will detect the presence of the tray MM using appropriate sensors and recognize the tray change sequence. A local visible signal will be given when no tray is present or that a filled tray must be removed. The trap door will not be allowed to open until an empty tray MM has been properly placed in position. The ASD control system can be linked to the mail sorter control system by replacing the existing stacker limit switches with signals from the ASD to indicate warning or fault conditions at the sweep station.

FIGS. 4*a*, 4*b* and 4*c* present an alternative design which has the advantages of offering a simpler stack penetrating and separating device than the combination of plates 35, 36. In this embodiment, a thin blade 70 is inserted into the stack from below and replaces the overhead rotating and translating sweep plate 36 and forward support plate 35. The rear support plate 37 is retained. However, the motor is not required, and the lead screw is replaced by a smooth guide rod 72.

The separating blade 70 is mounted to the end of an extendable rod 75 of an air cylinder 76 (as shown in FIG. 4*b*) and the air cylinder is mounted to the ASD by a bracket 77. The blade 70 is inserted into the mail stack when the rear support plate 37 has reached the stack limit, and initiates the door opening sequence. When the unsupported mail stack S has fallen into the tray MM below, the rear support plate 37 is driven to the right by the counterweight 40 until it contacts the blade 70. The blade is then retracted and the rear support plate 37 now supports the left portion of the stack. The doors are closed and the mail stack accumulates toward the left, driving back the rear support plate and repeating the sequence.

Figure 5:
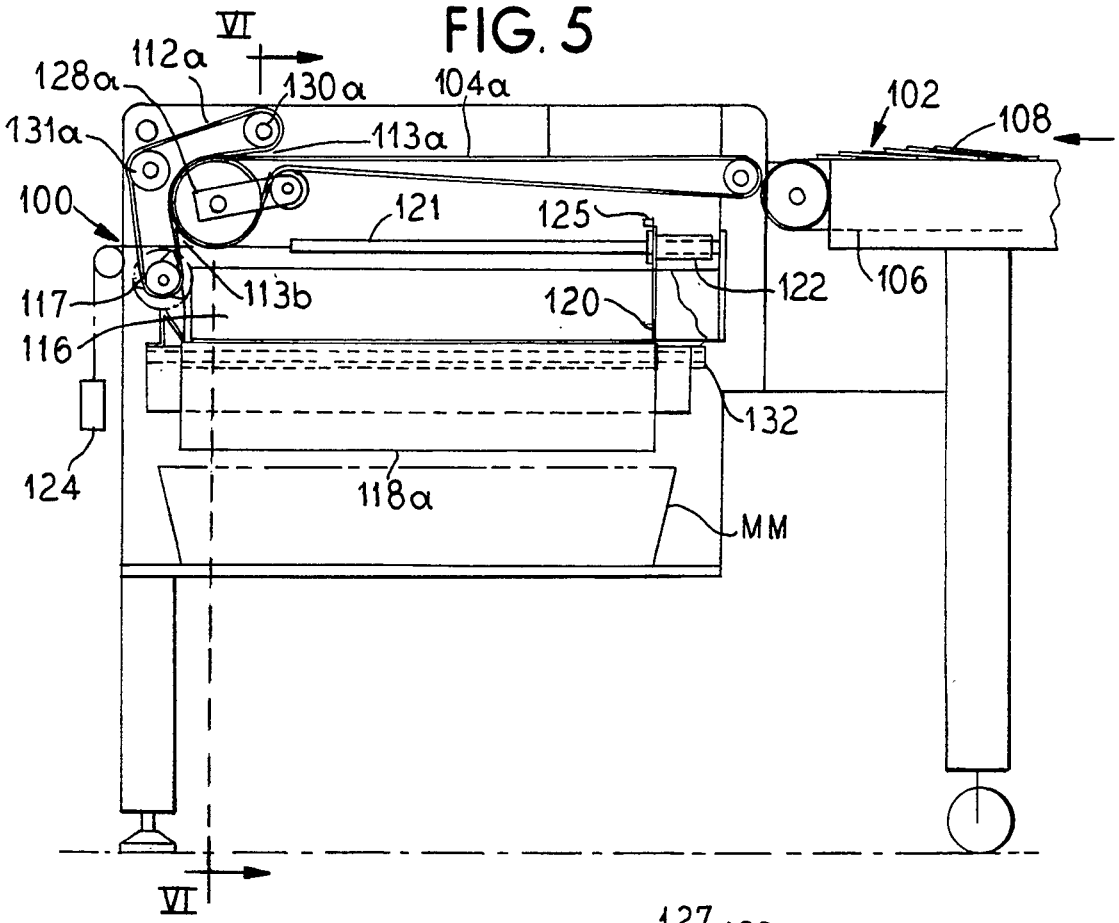
FIG. 5 is a front elevational view of an alternate arrangement of the present invention.

FIG. 5 is a side view of an alternate ASD (Automatic Stacking Device) 100 with the near side panel removed. The ASD 100 is shown fronting a conveyor machine 102 such as a Xerox Cheshire Mod Series machine. Two flat belts 104*a*, 104*b* are placed at a level for receiving input letters 108 riding on an output conveyor 106 of the machine 102. The flat belts are driven by an electric motor (not shown) via a drive pulley 109 at approximately the same velocity as the output conveyor 106 to provide a smooth transition and continuous flow of mail.

The letters 108 are carried to the left and toward opposing pinch belts 112*a*, 112*b* positioned above. The pinch belts 112*a*, 112*b* and the flat belts 104*a*, 104*b* merge together in a substantially horizontal nip 113*a* and diverge at a substantially vertical nip 113*b* which opens to a vertical stacking area creating the horizontal stack S. The pinch belts 112*a*, 112*b* convey the letters 108 through a 90° arc and direct the letters to the vertical stacking area 116 via a beater wheel 117. The letters thus stacked are supported on a pair of hinged doors 118*a*, 118*b* which are initially closed. An empty tray MM is in position below the doors.

Figure 7:
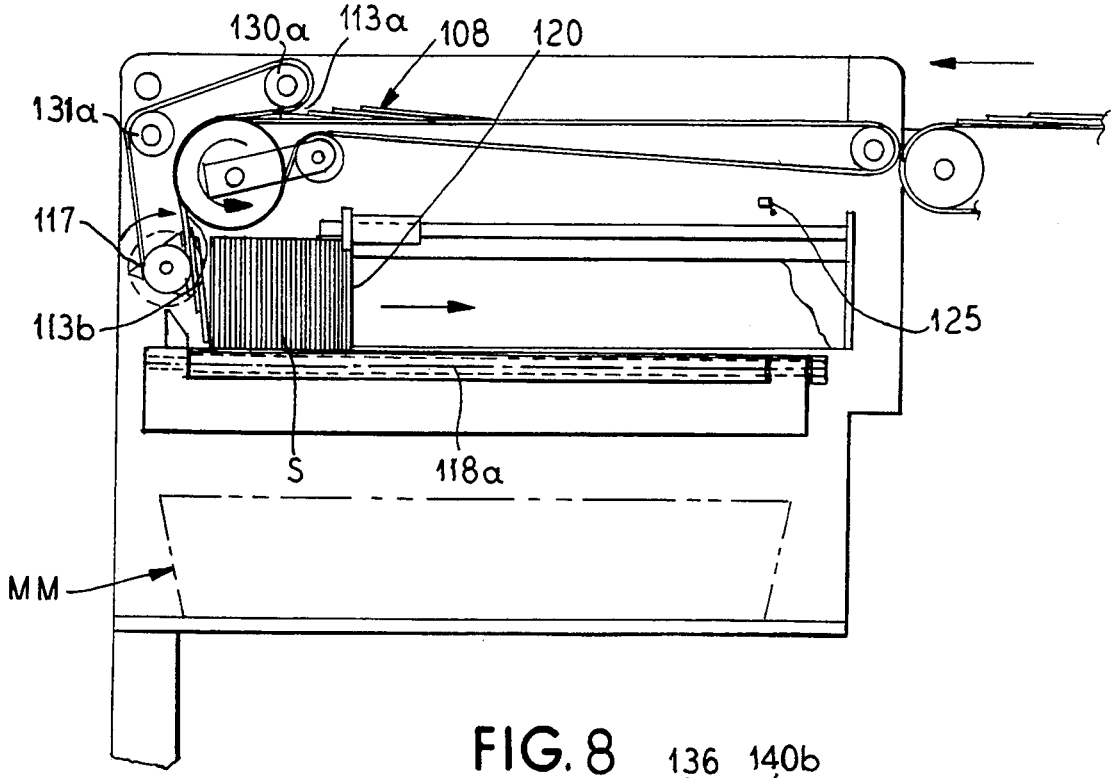
FIG. 7 is a partial elevational view of the invention of FIG. 5 in a second stage of mail loading.

The stack accumulates to the right, and is supported by a guided vertical plate 120, which translates along a rod 121 such that the plate 120 moves with the growing stack S (see FIG. 7). A stop 122 of selected width is mounted to the plate 120 to locate the plate at a terminus of the doors 118*a*, 118*b*. A counterweight 124 is attached to the plate 120 and provides a slight force to the left, to maintain the vertical orientation of pieces of the stack and to provide a returning force when the stack has been discharged.

Upon reaching a stack length appropriate for the tray MM, a limit switch 125 detects the position of the plate 120. An ASD control system then commands the doors 118*a*, 118*b* to open and the letter stack S falls as a contiguous block into the tray MM below.

Figure 6:
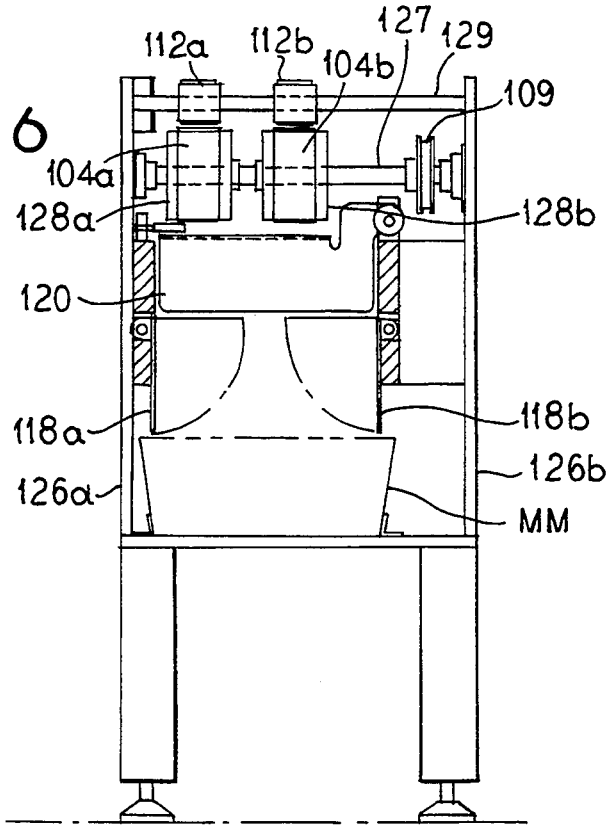
FIG. 6 is a sectional view taken generally along line VI—VI of FIG. 5.

FIG. 6 shows a sectional view of the ASD and the position of the hinged doors 118*a*, 118*b* above the tray MM. The door opening mechanism can be pneumatic, and provides rapid and simultaneous opening of the doors. The closure of the doors 118*a*, 118*b* can alternatively be controlled to a slower and more gentle rate.

Sidewalls 126*a*, 126*b* are provided for cladding the ASD 100 and for serving as structural support for an axle 127 which holds rollers 128*a*, 128*b* fixedly thereon. The rollers 128*a*, 128*b* hold the flat belts 104*a*, 104*b* respectively. The drive pulley 109 rotates the axle 127 which rotates the rollers 128*a*, 128*b*. An additional axle 129 holds pinch rollers 130*a*, 130*b* thereon. Apex rollers 131*a*, 131*b* are arranged at a corner between the beater wheel 117 and the pinch rollers 130*a*, 130*b*, arranged to allow the pinch belts 112*a*, 112*b* to partially surround the perimeters of the rollers 128*a*, 128*b*.

Figure 8:
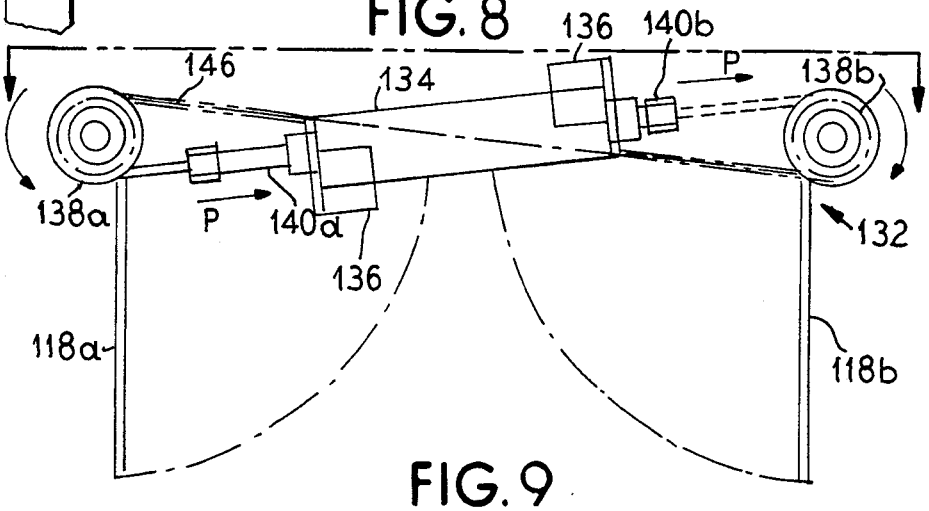
FIG. 8 is a right side elevational view of a door closing device of FIG. 5.
Figure 9:
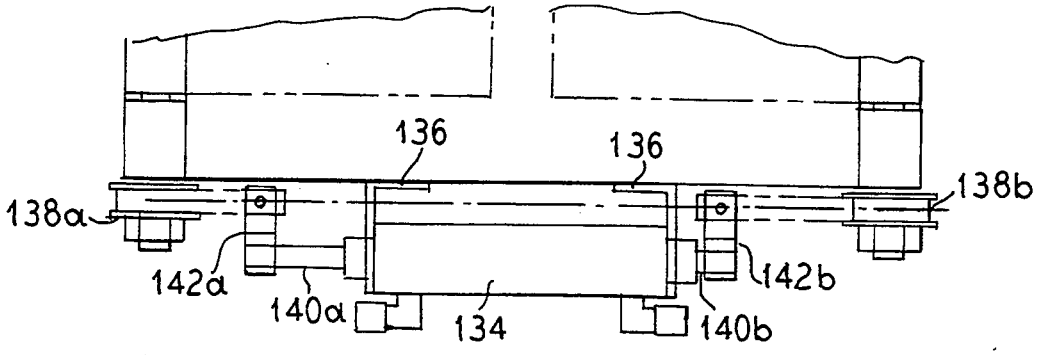
FIG. 9 a top view of the door closing device of FIG. 8.

FIGS. 8 and 9 show a door closure device 132, although other mechanisms and arrangements can be used. A double end, double acting cylinder 134 is mounted via brackets 136 to the ASD 100 frame. The doors 118*a*, 118*b* have actuating pulleys 138*a*, 138*b* mounted thereto for causing rotating opening or closing of the doors 118*a*, 118*b*. The cylinder 134 has two actuation rods 140*a*, 140*b*, one protruding from each end thereof. Attached to each rod 140*a*, 140*b* is a belt attachment fitting 142*a*, 142*b* respectively. A timing belt 146 is wound around the pulleys 138*a*, 138*b* in a "figure 8" fashion. The attachment fittings 142*b*, 142*a* are connected to the timing belt 146 at a top side of the "figure 8" and the bottom side of the "figure 8" respectively. Upon movement of the actuator rods 140*a*, 140*b* in a direction P in FIG. 8, the doors 118*a*, 118*b* are rotated closed. Reverse movement of the rods opens the doors 118*a*, 118*b*.

During the door opening sequence, and as long as the doors remain in the opened position, the ASD belt drive system is stopped, and mail is not accepted from the upstream output conveyor. The ASD control system can either interact with the output conveyor drive system and the label placement machine to inhibit the transportation of mail during this time, or a predetermined count system can be used in the label placement machine to generate one stack length of mail and pause. The ASD can detect a gap in the input mail stream and use the time period of the gap to complete the stack vertical transfer.

The ASD as originally designed and tested requires the manual removal of the full mail stack and replacement with an empty MM tray. Automatic removal and replacement of the trays can be easily accommodated, along with the addition of sensors and control logic to carry the automation to the next level.

Although the present invention has been described with reference to a specific embodiment, those of skill in the art will recognize that changes may be made thereto without departing from the scope and spirit of the invention as set forth in the appended claims.

We claim as our invention:

1. A piece sweeping device for receiving and relocating a stream of pieces, comprising:

an accumulation platform having an open side for receiving a stream of pieces and having an openable floor;

a tray platform arranged below said accumulation platform;

a means for holding said stream of pieces received onto said accumulation platform horizontally stacked, each piece of said stream of pieces held vertically upright, in a horizontal stack of select length; and said tray platform sized for holding a tray for receiving said horizontal stack of pieces through said openable floor.

2. The device of claim 1 wherein said means for holding comprises an end support plate and a forward support plate adapted to divide said stack into said select length.

3. The device of claim 2 wherein said end support plate is slidable and resiliently urged toward said stream of pieces being received by said accumulation platform.

4. The device of claim 3 wherein said means for holding comprises a cable attached to said end support plate, and a pulley attached to said accumulation platform, and a weight attached to an end of said cable opposite said end support plate, said cable draped over said pulley.

5. The device of claim 1 wherein said means for holding comprises:

an end support plate slideably mounted to said accumulation platform and positionable at an end of said openable floor opposite said stream of pieces, and a sweep plate mounted for sliding movement with respect to said accumulation platform, and mounted to be selectively removable from a path of said stream of pieces being stacked, and mounted to a means for imparting sliding force to said sweep plate toward said end support plate to compress a horizontal stack of pieces therebetween.

6. The device of claim 5 wherein said means for holding comprises a forward support plate mounted to be selectively moveable out of said path of the stream of pieces being stacked, at a receiving end of said accumulation platform, said forward support plate located at a fixed position along said path with respect to said accumulation platform.

7. The device of claim 5 wherein said sweep plate comprises a threaded bore, and said means for imparting comprises a threaded rod arranged parallel to a sliding direction of said sweep plate and piercing said threaded bore, and a motor for rotating said threaded rod about its axis, a threading of said rod through said threaded bore causing said sweep plate to translate in sliding fashion.

8. The device of claim 7 wherein said sweep plate is supported on a lateral side opposite said threaded bore by a roller mounted on a rail arranged attached to and parallel with said accumulation platform.

9. The device of claim 7 wherein said end support plate comprises a bushing and said threaded rod pierces said bushing, said bushing having an inside diameter greater than an outside diameter of said threaded rod to allow said bushing to slide freely along said threaded rod.

10. The device of claim 1 wherein said means for holding comprises:

an end plate positionable in a path of accumulation of pieces being stacked on said accumulation platform at a position on said openable floor opposite a receiving end of said accumulation platform;

a sweep plate mounted for selective movement into or out of the path of accumulation of pieces being stacked;

a forward support plate mounted for selective movement into and out of the accumulation path of pieces being stacked; and said sweep plate being mounted for forced sliding movement towards said end support plate to compress the stacked pieces therebetween, and said forward support plate mounted at a fixed position in the sliding direction of said sweep plate, and said sweep plate and said forward support plate having means allocated therebetween for interlocking said forward support plate and said sweep plate together for selectively moving said two plates out of said accumulation path of said pieces being stacked.

11. The device of claim 10 wherein said forward support comprises a bushing and said threaded rod pierces said bushing, said bushing having an inside diameter greater than an outside diameter of said threaded rod to allow said bushing to slide freely along said threaded rod.

12. The device of claim 11 wherein said sweep plate and said forward support plate are pivotable about an axis of said threaded rod to be removed from said accumulation pathway of said pieces being stacked.

13. The device of claim 1 wherein said means for holding comprises a blade and means for driving said blade upwardly to pierce said stream of pieces, said blade located at a position corresponding to said terminal end of said opening in said floor.

14. The device of claim 13 wherein said means for driving said blade comprises a pneumatic actuator.

15. The device of 1 wherein said openable floor comprises a pair of leaves pivotally mounted planarly parallel in a closed position and actuatable to swing downwardly, apart from each other, into an open position.

16. The device of claim 15 wherein said accumulation platform comprises opposite lateral sidewalls, and wherein said leaves are hinged to said opposite lateral sidewalls, hinged outside of a clear opening between said sidewalls, said leaves in said open position having a clearance therebetween at least equivalent to said clear opening.

17. The device of claim 1 wherein said means for holding further comprises a receiving conveyor belt having a roller at a rear end thereof, and a pinch belt partially conforming in abutting fashion to said receiving belt around a partial perimeter of said roller, said pinch belt and said receiving belt converging in a receiving nip at a first location and said receiving belt and said pinch belt diverging at a second location opening into said accumulation platform.

18. The device of claim 17 wherein said means for holding comprises an end support plate mounted for slidable movement from a position in said accumulation platform adjacent said divergence between said receiving belt and said pinch belt to a position at a respective opposite end of said accumulation platform.

19. A method for creating a horizontal stack of pieces and segregating those pieces into a package, comprising the steps of:

providing an accumulation platform having a selectively openable floor section and an open receiving end above and at one end of said floor section;

providing a translatable end plate resiliently urged toward said open receiving end and slidable to a stop position at a respective opposite end of said floor, the end support plate being urged towards said open receiving end;

accumulating pieces through said open receiving end and against said end support plate;

causing said accumulation to exert a pressure against said end support plate to translate said end support plate toward said stop position;

piercing said accumulation of pieces with a sweep plate at a position along said accumulation of pieces which defines a number of pieces between said end support plate and said sweep plate which corresponds to a stack length appropriate for a length of said package;

positioning said sweep plate at an end of said floor section opposite said end support plate;

providing an open top package;

positioning said package beneath said floor section; and opening said floor section to drop said stack into said package.

20. The method according to claim 19 comprising the further steps of:

piercing said stack with said sweep plate at a first position which defines a stack between said end support plate and said sweep plate which is temporarily longer than said appropriate length of said package; and translating said sweep plate towards said end support plate, while holding said end support plate stationary, to compress said stack to said appropriate length.

21. The method according to claim 20 comprising the further steps of:

providing a forward support plate;

with the piercing of said sweep plate into said stack also piercing said forward support plate into said stack on a side of said sweep plate opposite said end support plate;

retaining said forward support plate stationary while said sweep plate translates towards said end support plate.

22. A method of stacking and packaging incremental amounts of pieces received from a stream of pieces comprising the steps of:

receiving flat pieces translating in a horizontal plane;

individually turning said pieces from a horizontal orientation to a vertical orientation;

delivering said pieces to an accumulation area disposed beneath said horizontal plane;

providing an end support plate resiliently urged toward said pieces being accumulated thereagainst;

accumulating said pieces in a horizontal stack to a prescribed length;

providing that said accumulation area has an openable floor;

providing a package with an open top;

placing said package beneath said openable floor; and when said prescribed length is achieved, opening said floor and dropping said stack into said package.

* * * * *

UNITED STATES PATENT AND TRADEMARK OFFICE

CERTIFICATE OF CORRECTION

PATENT NO. : 5,347,790

DATED : September 20, 1994

INVENTOR(S) : Michael Romanenko et al.

It is certified that error appears in the above-indentified patent and that said Letters Patent is hereby corrected as shown below:

On the title page, item [21]: should read--Appl. No.: 983,976--.

Signed and Sealed this

Thirteenth Day of December, 1994

Bruce Lehman

*Attest:*

BRUCE LEHMAN

*Attesting Officer*

*Commissioner of Patents and Trademarks*